US007588455B2

(12) United States Patent
Matsumura et al.

(10) Patent No.: US 7,588,455 B2
(45) Date of Patent: Sep. 15, 2009

(54) CONNECTOR WITH ALIGNING PLATE

(75) Inventors: Kaoru Matsumura, Makinohara (JP); Akihiro Tsuruta, Fujieda (JP); Hiroshi Kobayashi, Okazaki (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/364,955

(22) Filed: Feb. 3, 2009

(65) Prior Publication Data

US 2009/0203248 A1 Aug. 13, 2009

(30) Foreign Application Priority Data

Feb. 8, 2008 (JP) ..... 2008-028605

(51) Int. Cl.
*H01R 13/627* (2006.01)

(52) U.S. Cl. ..... 439/357

(58) Field of Classification Search ..... 439/350–358, 439/364, 381, 157, 160, 347, 159, 141, 271, 439/140, 597, 686, 695, 701, 374, 680
See application file for complete search history.

(56) References Cited

U.S. PATENT DOCUMENTS 6,644,992 B2 * 11/2003 Maegawa ..... 439/157
6,939,163 B2 * 9/2005 Fujita ..... 439/381
7,249,958 B2 * 7/2007 Ishikawa et al. ..... 439/141

FOREIGN PATENT DOCUMENTS

JP 2002-343483 A 11/2002
JP 2006-253074 A 9/2006

* cited by examiner

*Primary Examiner*—Edwin A. Leon
(74) *Attorney, Agent, or Firm*—Sughrue Mion, PLLC

(57) ABSTRACT

A connector, includes: a connector housing including an engaging space to receive a mating connector through the entrance, and a terminal container; a male terminal including a base end fitted to the terminal container and an electric connecting portion extended from the base end into the engaging space; an aligning plate which is arranged within the engaging space, includes a terminal insertion hole for passing the electric connecting portion therethrough, and adapted to move in the engaging space between a temporarily and a permanently locked positions; a temporarily locking hook including a projection projected from an arm portion so as to hold the aligning plate at the temporarily locked position; and a contact part provided on the projection to contact the aligning plate, so that a vector for pulling the arm portion inward into the engaging space is generated when the aligning plate is pressed toward the terminal container.

5 Claims, 6 Drawing Sheets

CONNECTOR WITH ALIGNING PLATE

BACKGROUND OF THE INVENTION

1. Field of the Invention

The present invention relates to a connector provided with an aligning plate for supporting male terminals and for positioning the male terminals to prescribed positions.

2. Related Art

As a connector for electrically connecting electric wires which are arranged in a vehicle or the like, there are a so-called male connector and a female connector. Each of the connectors includes a connector housing, and terminals which are contained in the connector housing. The aforesaid female connector includes the connector housing having an engaging space for receiving the male connector and the terminals of male type (hereinafter referred to as male terminals). Base ends of these male terminals are mounted to the terminal container of the connector housing, and electric connecting portions extended from the base ends are positioned in the engaging space.

The electric connecting portions of the male terminals of the female connector are likely to be crooked, because they have a shape of an elongated rod, and there is a problem that positional deviation may occur with respect to the terminals of female type (hereinafter referred to as female terminals) which are contained in the mating male connector. In order to solve such a problem, there has been employed a female connector which is provided with an aligning plate (also called as a moving plate) for positioning the electric connecting portions of the male terminals at the prescribed positions, as shown in FIG. 5 (see JP-A-2002-343483 and JP-A-2006-253074, for example).

A female connector 101 which is shown in FIG. 5 includes a connector housing 104 having an engaging space 140 for receiving a mating male connector 102 along an inserting direction K and a terminal container 144 which is positioned at a deeper side than the engaging space 140 in the inserting direction K, a plurality of male terminals 105 having base ends mounted to the terminal container 144 and electric connecting portions positioned in the engaging space 140, and an aligning plate 103 which is formed separately from the connector housing 104 and provided so as to move in the engaging space 140.

The aligning plate 103 includes a plate part 130 having terminal insertion holes through which the electric connecting portions of the male terminals 105 are adapted to pass, and a pair of permanently locking arms 132 which are respectively extended from both ends of the plate part 130 in a longitudinal direction L.

Before the female connector 101 is engaged with the male connector 102, the aligning plate 103 stays at a temporarily locked position as shown by a solid line in FIG. 5, and respective surfaces 130*a* in both longitudinal end parts of the plate part 130 along the longitudinal direction L at a side facing the terminal container 144 are butted against temporarily locking hooks 106 which are provided on inner walls 141 defining the engaging space 140, whereby the aligning plate 103 is held by the temporarily locking hooks 106. In this manner, the aligning plate 103 is prevented from moving to the deep side, that is, toward the terminal container 144, unless the male connector 102 is inserted into the engaging space 140.

Moreover, when the male connector 102 is inserted into the engaging space 140 and the aligning plate 103 is pressed with this male connector 102 toward the terminal container 144, the temporarily locking hooks 106 are flexed outward of the engaging space 140 to be unlocked from the surfaces 130*a*, whereby the aligning plate 103 is moved to a permanently locked position which is shown by a one-dot chain line in FIG. 5. Then, a pair of the permanently locking arms 132 of the aligning plate 103 are locked to permanently locking locks 142 which are provided at a deeper side than the engaging space 140 in the connector housing 140, whereby the aligning plate 103 is fixed at the permanently locked position.

However, there are the following problems to be solved, in the female connector 101 provided with the above described known aligning plate 103. Specifically, on such an occasion that the female connector 101 is transported, in a state where the male terminals 105 are contained in the connector housing 104, the aligning plate 103 is inadvertently moved from the temporarily locked position to the permanently locked position at the deeper side, in some cases. More specifically, in case where a hand of a worker or a connector different from the mating connector is inserted into the engaging space 140 of the female connector 101, the plate part 130 of the aligning plate 103 is forcibly pressed to the deeper side, and the surfaces 130*a* are unlocked from the temporarily locking hooks 106, whereby the aligning plate 103 is moved from the temporarily locked position to the permanently locked position, in some cases.

This phenomenon is attributed to a holding structure of the aligning plate 103 by means of the temporarily locking hooks 106. Specifically, as shown in FIG. 6A, each of the temporarily locking hooks 106 is continued from the inner wall 141 as shown in FIG. 5, and composed of an arm portion 161 which extends toward the terminal container 144 in the inserting direction K, and a projection 163 which is projected from an end of the arm portion 161 remote from the inner wall 141 and adapted to be overlapped on the surface 130*a* of the aligning plate 103. When the plate part 130 is pressed toward the terminal container 144, the arm portion 161 of the temporarily locking hook 106 is flexed outward of the engaging space 140, and the surface 130*a* becomes less overlapped on the projection 163, as shown in FIG. 6B. As the results, the projection 163 is easily detached from the surface 130*a*, as shown in FIG. 6C.

In case where the aligning plate 103 has moved to the deeper side and is not at the temporarily locked position, the electric connecting portions of the male terminals 105 are made free, and easily deformed with interference of the hand of the worker or the connector different from the mating connector. Even though the male terminals 105 are not interfered with the hand of the worker or the connector different from the mating connector, the electric connecting portions of the male terminals 105 may sway, since they are not positioned by the aligning plate 103, and there is such anxiety that the male terminals 105 may not be properly engaged with the female terminals.

SUMMARY OF THE INVENTION

Under the circumstances, this invention has been made in view of the above described problems, and it is an object of the invention to provide a connector with an aligning plate in which the aligning plate can be reliably held at a temporarily locked position.

In order to attain the above described object, there is provided a connector including:

a connector housing having an inner wall;

an engaging space which is provided in the connector housing, and has an entrance to receive a mating connector through the entrance;

a terminal container which is provided in the connector housing to be opposed to the entrance of the engaging space;

a male terminal including a base end fitted to the terminal container and an electric connecting portion extended from the base end into the engaging space;

an aligning plate which is arranged within the engaging space, is provided with a terminal insertion hole for passing the electric connecting portion therethrough, and is adapted to move in the engaging space between a temporarily locked position and a permanently locked position, the temporarily locked position representing a position in which the terminal insertion hole is positioned at one end part of the electric connecting portion remote from the base end prior to engagement of the mating connector, and the permanently locked position representing a position in which the terminal insertion hole is positioned at the other end part of the electric connecting portion close to the base end after the engagement of the mating connector;

a temporarily locking hook including: an arm portion which is extended from the inner wall toward the terminal container and positioned outside of the aligning plate; and a projection which is projected from an end of the arm portion remote from the inner wall and adapted to be bufted against a surface of the aligning plate at a side facing the terminal container so as to hold the aligning plate at the temporarily locked position; and a contact part provided on the projection to contact the aligning plate, so that a vector for pulling the arm portion inward into the engaging space is generated when the aligning plate is pressed toward the terminal container.

In the above-mentioned connector, the aligning plate may include a dent in a concave shape, and the contact part may be brought into contact with an inner face of the dent.

In the above-mentioned connector, the contact part may be brought into line contact with the aligning plate.

In the above-mentioned connector, the arm portion may be curved in a direction toward a center of the engaging space as the arm portion goes toward the terminal container, in a state where a pressure is not applied to the arm portion.

In the above-mentioned connector, the aligning plate may include a shearing part which has a smaller thickness than other parts of the aligning plate, and is adapted to be sheared when the aligning plate is pressed toward the terminal container with a force exceeding a limit value of stress thereof.

According to the above configurations, the temporarily locking hook is provided to include: an arm portion which is extended from the inner wall toward the terminal container and positioned outside of the aligning plate; and a projection which is projected from an end of the arm portion remote from the inner wall and adapted to be butted against a surface of the aligning plate at a side facing the terminal container so as to hold the aligning plate at the temporarily locked position, and a contact part is provided on the projection to contact the aligning plate, so that a vector for pulling the arm portion inward into the engaging space is generated when the aligning plate is pressed toward the terminal container.

Therefore, when the aligning plate is forcibly pressed toward the terminal container by a worker's hand or another connector different from the mating connector to be engaged, the arm portion of the temporarily locking hook is pulled inward into the engaging space to be flexed inwardly. Accordingly, decrease of an overlapping amount between the projection and the surface of the aligning plate is eliminated, and hence, the aligning plate is prevented from moving toward the terminal container across this projection. As the results, the aligning plate is prevented from moving toward the terminal container, unless the aligning plate is pressed with engaging action of the mating connector. In this manner, it is possible to provide the connector with the aligning plate in which the aligning plate can be reliably held at the temporarily locked position.

According to the above configurations, the dent in a concave shape is formed in the aligning plate, and the inner face of the dent is brought into contact with the contact part. Therefore, it is possible to increase the overlapping amount between the projection and the surface of the aligning plate, without increasing a thickness of the aligning plate. Moreover, it is also possible to make an inclination angle of a part of the inner face of the dent to be butted against the contact part acute with respect to a direction of the surface of the aligning plate, without increasing the thickness of the aligning plate.

According to the above configurations, the contact part is so provided as to be brought into line contact with the aligning plate, and therefore, it becomes easy to make the vector generated in the contact part directed so as to approach a center of the engaging space.

According to the above configurations, the arm portion is curved in a direction toward the center of the engaging space as it goes toward the terminal container, in a state where a pressure is not applied to the arm portion. Therefore, an inclination angle of a taper face of the projection can be made acute with respect to the direction of the surface of the aligning plate, and the vector generated in the contact part which is positioned on the taper face can be easily directed so as to approach the center of the engaging space. Moreover, when a pressure is applied to the projection, the arm portion is elastically deformed from the curved shape to a rectilinear shape, and hence, decrease of the overlapping amount between the projection and the surface of the aligning plate is eliminated.

According to the above configurations, the aligning plate includes the shearing part which has a smaller thickness than other parts of the aligning plate, and is adapted to be sheared when the aligning plate is pressed toward the terminal container with a force exceeding a limit value of stress thereof. Therefore, it is possible to prevent the temporarily locking hook from being broken, and the connector housing can be re-used, by exchanging the aligning plate which has been broken.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIGS. 3A to 3D are explanatory views for explaining operation of a holding structure of the aligning plate by means of a temporarily locking hook in the connector shown in an encircled part III in FIG. 1, in which FIG. 3A is a view showing the aligning plate before it is held by the temporarily locking hook; FIG. 3B is a view showing the aligning plate held by the temporarily locking hook; FIG. 3C is a view showing a state where the aligning plate which is held by the temporarily locking hook is pressed; and FIG. 3D is a view showing a state where the aligning plate as shown in FIG. 3C is further pressed with a larger force;

DETAILED DESCRIPTION OF THE PREFERRED EMBODIMENTS

Now, a connector with an aligning plate according to an embodiment of the invention will be described referring to FIGS. 1 to 4.

Figure 1:
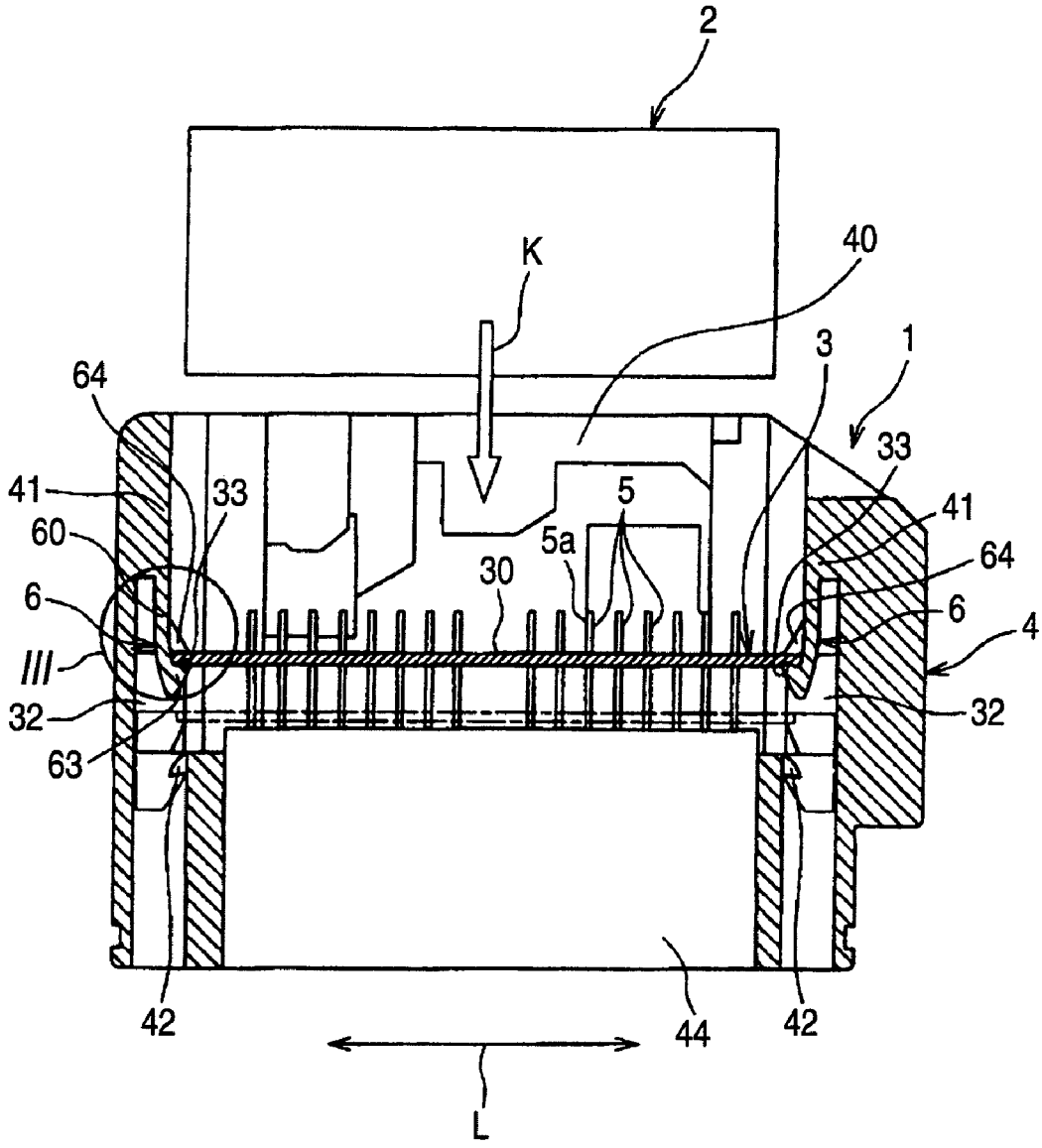
FIG. 1 is a sectional view showing a connector with an aligning plate according to an embodiment of the invention.
Figure 2A:
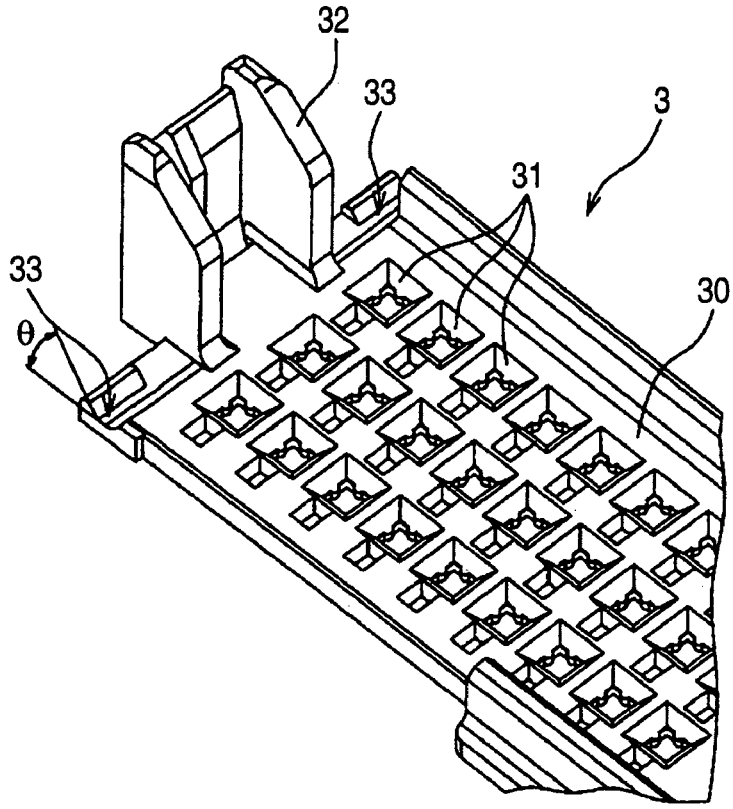
FIG. 2A is a perspective view showing the aligning plate in the connector as shown in FIG. 1.
Figure 2B:
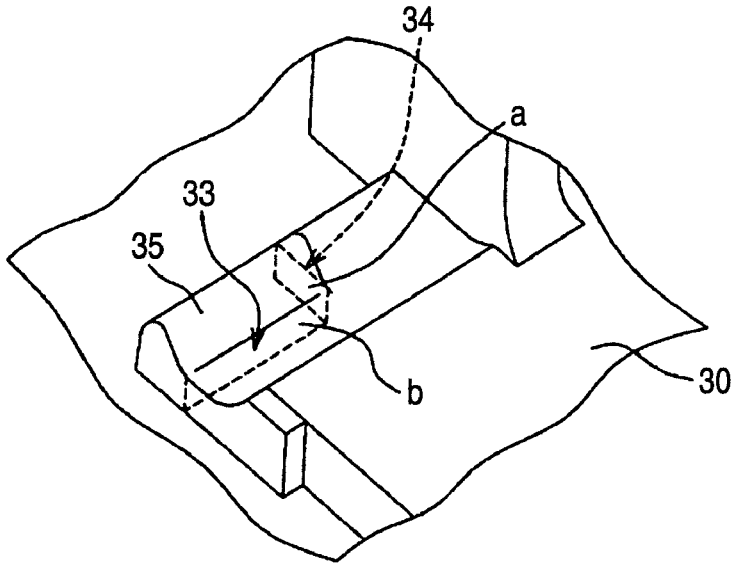
FIG. 2B is an enlarged perspective view showing an essential part of the aligning plate as shown in FIG. 2A.
Figure 3A:
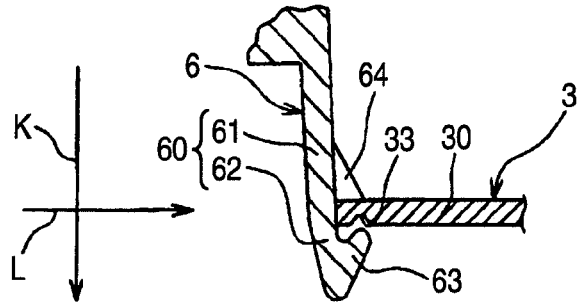
Figure 3B:
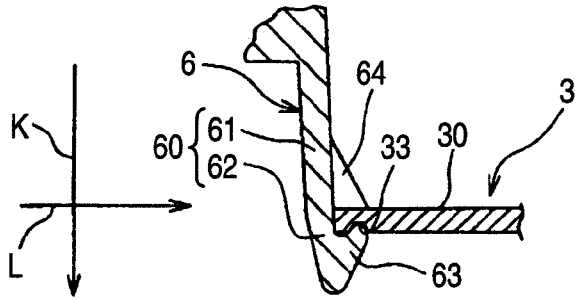
Figure 3C:
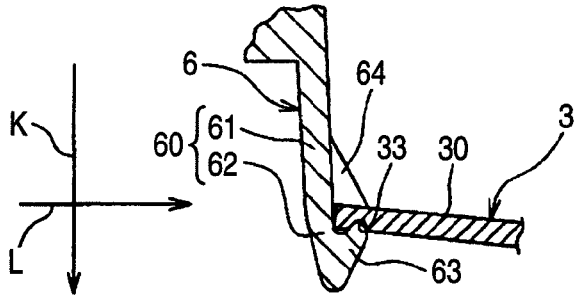
Figure 3D:
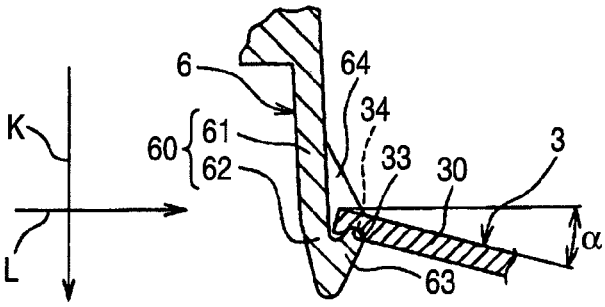
Figure 4:
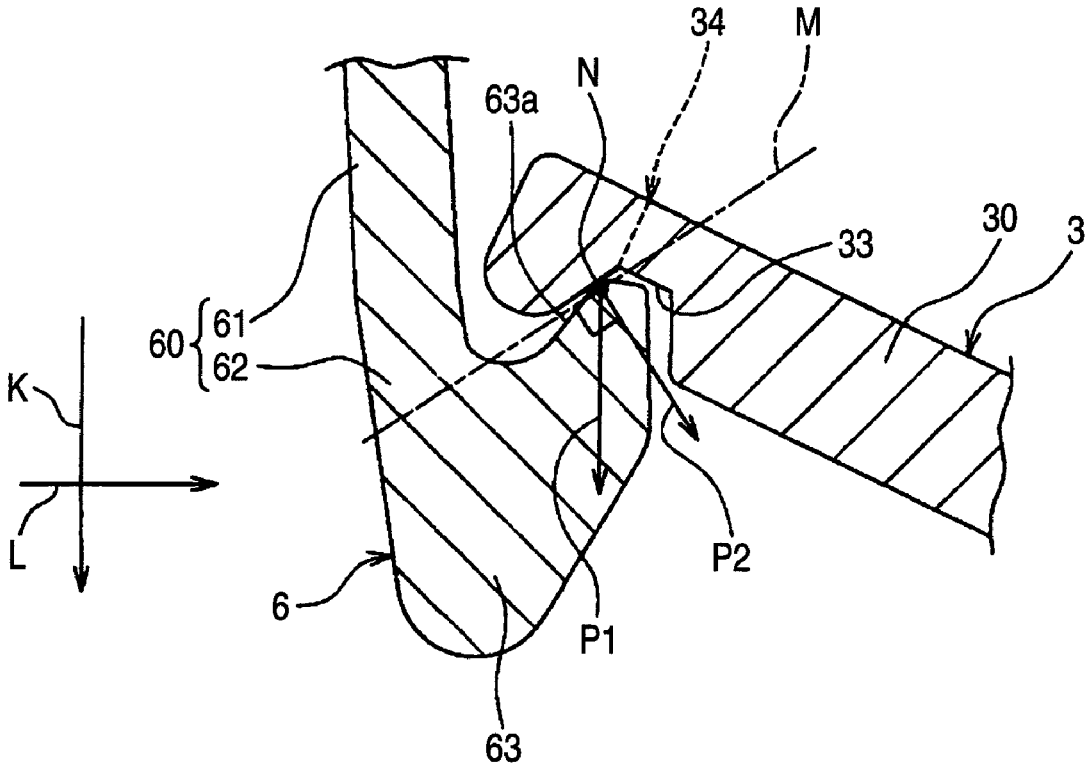
FIG. 4 is an explanatory view for explaining vectors which are generated in a contact part of the temporarily locking hook in the state as shown in FIG. 3D.
Figure 5:
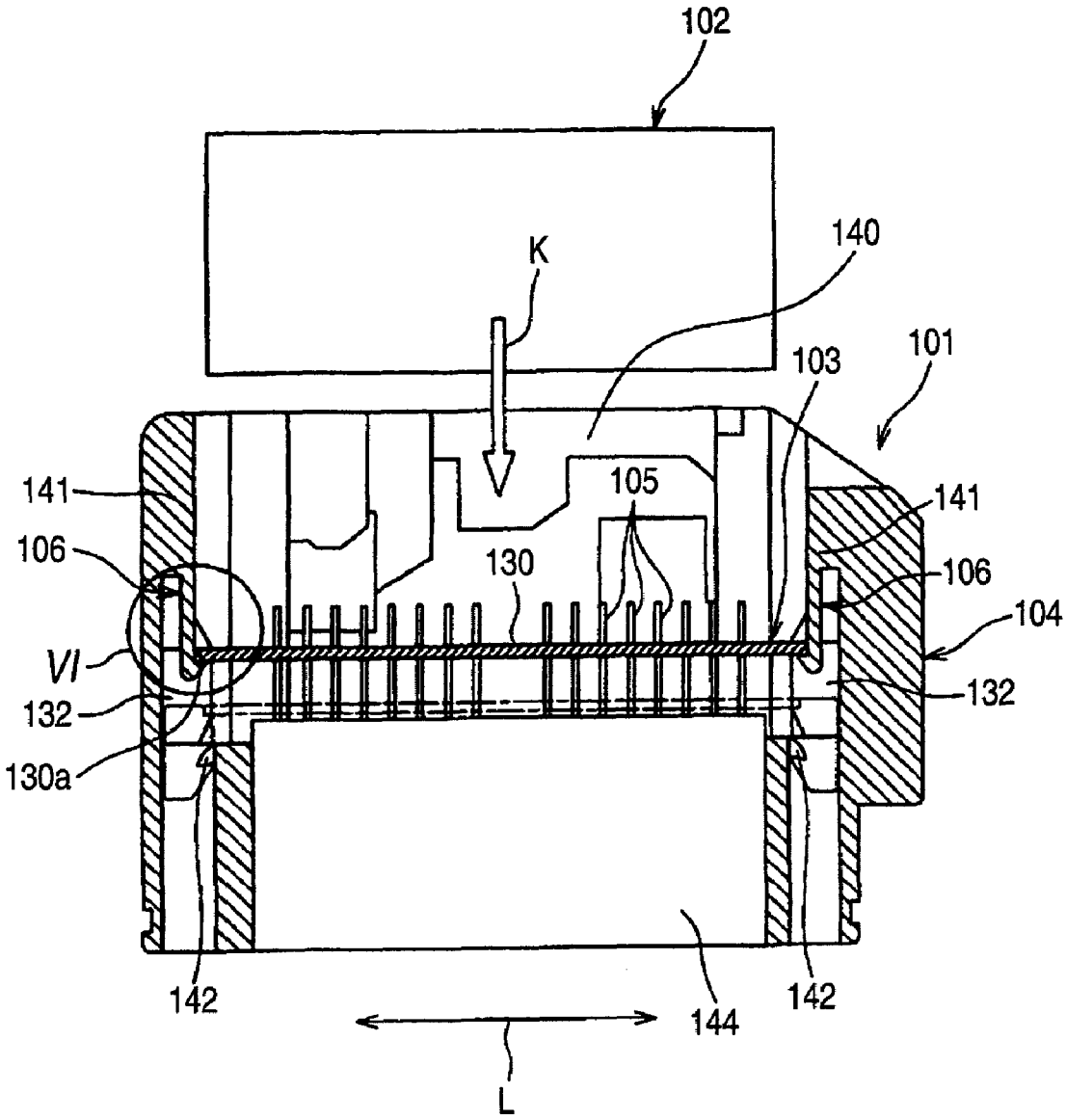
FIG. 5 is a sectional view showing a known connector with an aligning plate.
Figure 6A:
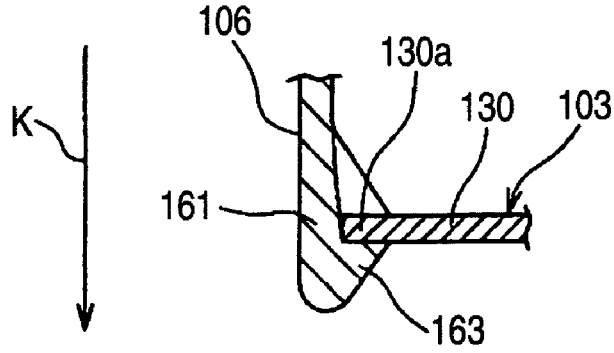
FIGS. 6A to 6C are explanatory views for explaining operation of a holding structure of the aligning plate by means of a temporarily locking hook of the connector with the aligning plate as shown in an encircled part VI in FIG. 5.
Figure 6B:
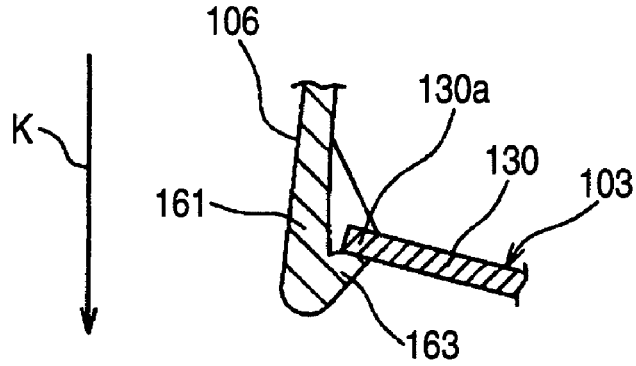
Figure 6C:
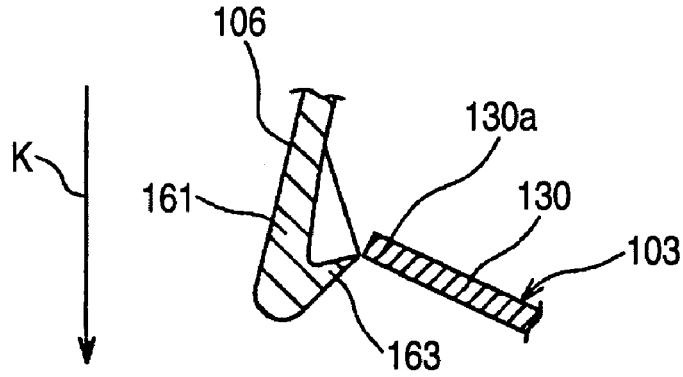

FIG. 1 is a sectional view showing a connector with an aligning plate according to an embodiment of the invention. FIG. 2A is a perspective view showing the aligning plate in the connector as shown in FIG. 1, and FIG. 2B is an enlarged perspective view showing an essential part of the aligning plate as shown in FIG. 2A. FIGS. 3A to 3D are explanatory views for explaining operation of a holding structure of the aligning plate by means of a temporarily locking hook in the connector as shown in FIG. 1, in which FIG. 3A is a view showing the aligning plate before it is held by the temporarily locking hook; FIG. 3B is a view showing the aligning plate held by the temporarily locking hook; FIG. 3C is a view showing a state where the aligning plate which is held by the temporarily locking hook is pressed; and FIG. 3D is a view showing a state where the aligning plate as shown in FIG. 3C is further pressed with a larger force. FIG. 4 is an explanatory view for explaining vectors which are generated in a contact part of the temporarily locking hook in the state as shown in FIG. 3D.

As shown in FIG. 1, a connector 1 according to the embodiment of this invention includes a connector housing 4, a plurality of male terminals 5, and an aligning plate 3.

The connector housing 4 is formed of insulating synthetic resin, and has an engaging space 40 for receiving a male connector 2 as a mating connector along an inserting direction K, and a terminal container 44 which is arranged at a deeper side than this engaging space 40 in the inserting direction K. Moreover, a pair of inner walls 41 opposed to each other, out of the inner walls defining the engaging space 40, are respectively provided with two (four in total) temporarily locking hooks 6 for holding the aligning plate 3 at a temporarily locked position, which will be described below.

The temporarily locking hooks 6 are formed at positions to be locked to four corners of a plate part 30 of the aligning plate 3, which will be described below. As shown in FIGS. 3 and 4, each of the temporarily locking hooks 6 includes an arm portion 60 which is extended from the inner wall 41 defining the engaging space 40 toward the terminal container 44, and positioned outside both ends in a longitudinal direction L of the plate part 30, a projection 63 which is projected from an end of the arm portion 60 remote from the inner wall 41 and adapted to be butted against a surface of the plate part 30 at a side facing the terminal container 44, and a releasing plate portion 64 which connects a side face of the arm portion 60 to a side face of the projection 63. When the male connector 2 is engaged, this releasing plate portion 64 is pressed with this male connector 2 thereby to flex the arm portion 60 outward of the engaging space 40. In this manner, the plate part 30 is released from being held by the temporarily locking hook 6, and allowed to move toward the terminal container 44.

A plurality of the male terminals 5 as described above are obtained by stamping metal plates having electrical conductivity, each having a base end (not shown) which is attached to the terminal container 44, and a rod-shaped electric connecting portion 5*a* which is adapted to be positioned in the engaging space 40. This electric connecting portion 5*a* is engaged with a female terminal of the male connector 2.

The aligning plate 3 is formed as a separate body from the connector housing 4, for the purpose of positioning the electric connecting portions 5*a* at prescribed positions. Moreover, the aligning plate 3 is inserted into the engaging space 40 from an opening (entrance) of the engaging space 40 and so provided as to move in the inserting direction K in the engaging space 40. As shown in FIG. 2A, this aligning plate 3 has the plate part 30 in a plate-like shape, and a pair of permanently locking arms 32 which are respectively extended from both ends in the longitudinal direction L of the plate part 30.

The plate part 30 has a plurality of terminal insertion holes 31 through which the electric connecting portions 5*a* are adapted to be inserted. Specifically, the aligning plate 3 sets positions of the electric connecting portions 5*a*, by positioning the electric connecting portions 5*a* in the terminal insertion holes 31. Moreover, the four corners of the plate part 30 are respectively supported by the temporarily locking hooks 6, whereby the plate part 30 is held at a temporarily locked position, as shown by a solid line in FIG. 1. Further, the aligning plate 3 is inserted into the engaging space 40 in such a manner that a direction of thickness of the plate part 30 may be in parallel with the inserting direction K.

A pair of the permanently locking arms 32 are respectively provided in both end parts in the longitudinal direction L of the plate part 30 and at a center in a lateral direction of the plate part 30. Moreover, these permanently locking arms 32 are erected from the surface of the plate part 30 at a side facing the terminal container 44. When the aligning plate 3 is moved to the permanently locked position which is shown by a one-dot chain line in FIG. 1, the permanently locking arms 32 are locked to permanently locking locks 42 which are provided at a deeper side than the engaging space 40 in the connector housing 4, thereby to fix the aligning plate 3 at the aforesaid permanently locked position.

The aligning plate 3 as described above is inserted into the engaging space 40 along the inserting direction K from the opening (entrance) of the engaging space 40, and set at the aforesaid temporarily locked position, as shown in FIG. 3A. In the state where the aligning plate 3 is positioned at the temporarily locked position, that is, prior to engagement of the male connector 2, one end parts (or intermediate parts) of the electric connecting portions 5*a* remote from the base ends are positioned in the terminal insertion holes 31.

Then, along with the engagement of the male connector 2, the plate part 30 is released from being held by the temporarily locking hooks 6, and pressed by the male connector 2 to the deeper side, that is, toward the terminal container 44 thereby to be moved to the permanently locked position. In the state where the plate part 30 is positioned at the permanently locked position, that is, in the state where the male connector 2 has been engaged with the connector 1 with the aligning plate, the other end parts of the electric connecting portions 5*a* close to the base ends are positioned in the terminal insertion holes 31.

Then, a structure for holding the aligning plate 3 by the temporarily locking hooks 6 will be described in detail.

In the connector 1 according to the embodiment of the invention, a holding force of the aligning plate 3 by the temporarily locking hooks 6 is made high according to the following structure, for the purpose of enabling the aligning plate 3 to be reliably held at the temporarily locked position, even though a worker's hand or another connector different from the mating connector to be engaged is inadvertently inserted into the engaging space 40, during transportation of the connector, for instance, in a state where the male terminals 5 and the aligning plate 3 are contained in the connector housing 4.

Specifically, in the embodiment of this invention, the temporarily locking hooks 6 and the aligning plate 3 are designed in such a manner that when the plate part 30 of the aligning plate 3 which is held at the temporarily locked position is forcibly pressed toward the terminal container 44 with the worker's hand or the other connector different from the mating connector to be engaged, the arm portions 60 of the temporarily locking hooks 6 are flexed inward into the engaging space 40, as shown in FIGS. 3C and 3D, so that an escape of the plate part 30 toward the terminal container 44 may be prevented.

Moreover, shearing parts 34 are respectively provided in the four corners of the plate part 30. When the plate part 30 of the aligning plate 3 which is held at the temporarily locked position is forcibly pressed with a large force exceeding a limit value of stress, by the worker's hand or the other connector different from the mating connector to be engaged, the shearing parts 34 are sheared, thereby to release the lock of the plate part 30 by the temporarily locking hooks 6. These shearing parts 34 will be described below.

In order to flex the arm portions 60 inwardly, as described above, specifically, the plate part 30 of the aligning plate 3 is provided with dents 33 which are formed in a concave shape recessed from the surface of the plate part 30, in the four corners of the surface of the plate part 30 at a side facing the terminal container 44. Tip ends of the projections 63 of the temporarily locking hooks 6 are locked to these dents 33. Each of the projections 63 is projected so as to approach a center of the engaging space 40 as it goes to the tip end, and at the same time, projected in a direction from the terminal container 44 to the opening of the engaging space 40.

Further, the arm portion 60 of the temporarily locking hook 6 includes a first portion 61, and a second portion 62 which is continued from the first portion 61 and extended in a direction toward the center of the engaging space 40. As a whole, the arm portion 60 is so provided as to be curved in a direction toward the center of the engaging space 40, as it goes from the opening of the engaging space 40 to the terminal container 44.

When the plate part 30 in the state as shown in FIG. 3B is forcibly pressed toward the terminal container 44 with the worker's hand or the other connector different from the mating connector to be engaged, as shown in FIGS. 3C and 3D, an inner face of the dent 33 is butted against the tip end of the projection 63, whereby the tip end of the projection 63 is brought into line contact with the inner face of the dent 33. A part of the tip end of the projection 63 to be brought into the line contact on this occasion is called as "a contact part" in this embodiment. Further, vectors generated in this contact part will be described referring to FIG. 4.

A point N in FIG. 4 represents the contact part of the projection 63 with respect to the inner face of the dent 33. A one-dot chain line M represents a tangent line of the contact part N. An arrow mark P1 represents a load existing on the contact part N which is generated, when the plate part 30 is pressed, as a vector. A direction of this load P1 is in parallel with the inserting direction K. An arrow mark P2 represents a force of the inner face of the dent 33 pressing the contact part N perpendicularly to the tangent line M, as a vector. In short, the arrow mark P2 is the vector generated in the contact part.

In order to flex the arm portion 60 inward into the engaging space 40, it would be sufficient that the vector P2 is directed to the center of the engaging space 40 rather than the direction of the load P1. Specifically, "the vector capable of pulling the arm portion 60 inward into the engaging space 40" is "the vector which is directed to the center of the engaging space 40 rather than the direction of the load P1, that is, the inserting direction K".

In order to generate the vector P2 which is directed as described above in the contact part N, an inclination angle of a taper face 63*a* (See FIG. 4) of the projection 63 having the contact part N must be an acute angle with respect to the longitudinal direction L of the plate part 30 (that is, the direction of the surface of the plate part 30 which is not flexed). The "acute angle" is such an angle that the tangent line M of the contact part N is not parallel to the longitudinal direction L, even in case where the plate part 30 is pressed against the projection 63, and where an angle between the arm portion 60 and the taper face 63*a* is enlarged. At this acute angle, the tangent line M becomes an inclined rectilinear line which is directed outward of the engaging space 40, as it goes to the deeper side than the engaging space 40. Moreover, an edge positioned at the tip end of this taper face 63*a* constitutes the aforesaid contact part N.

Additionally, in order to bring the surface of the plate part 30 at the side facing the terminal container 44 into contact with the contact part N which is provided on the taper face 63*a* having the acute inclination angle as described above, it is also necessary to make an inclination angle of the relevant surface acute. However, according to the embodiment of the invention, because the dent 33 is formed as described above, and the inner face of the dent 33 is brought into contact with the contact part N, it is possible to press the plate part 30 against the contact part N, without increasing a thickness of the plate part 30. Moreover, by providing this dent 33, it is possible to increase an overlapping amount between the projection 63 and the plate part 30.

Further, according to the invention, it is not necessarily required to bring the contact part N into line contact with the surface of the plate part 30, that is, the inner face of the dent 33, but the contact part N may be brought into face contact. However, by bringing the contact part N into the line contact as described above, it becomes easy to make the vector P2 directed so as to approach the center of the engaging space 40. In short, it becomes easier to finely adjust the direction of the vector P2.

The shearing part 34 is shown by a dotted line in FIGS. 2B and 4. Specifically, the shearing part 34 is provided in a bottom part of the dent 33, surrounding a protruded part 35 (See FIG. 2B) which is protruded from the bottom part. The "bottom part of the dent 33" means those areas which are formed having the smallest thickness, in the four corners of the plate part 30. Moreover, the protruded part 35 is a part constituting the inner face of the dent 33, and has a region to be brought into line contact with the contact part N. A shearing force of this shearing part 34 means the shearing force for a sectional plane "a" and a sectional plane "b" surrounding the protruded part 35. Therefore, when the plate part 30 is pressed, the plate part 30 and the temporarily locking hook 6 are flexed, until the shearing part 34 is sheared. When the pressure exceeding this shearing force is applied to each of the four corners of the plate part 30, the shearing part 34, that is, the sectional planes "a" and "b" are sheared to detach the protruded part 35, whereby the projection 63 loses the locked region with respect to the plate part 30, and will be disengaged from the plate part 30.

An upper limit value of the aforesaid load P1 is equal to the shearing force of the aforesaid shearing part 34.

In this embodiment of the invention, the aligning plate 3 is provided with the shearing parts 34 as described above, and hence, it is possible to prevent the temporarily locking hooks 6 from being broken, while the force for holding the plate part 30 by the temporarily locking hooks 6 is enhanced. Specifically, in case where a larger force exceeding the limit value of the stress is applied to the plate part 30, the aligning plate 3 is sheared, that is, broken. Therefore, it is possible to re-use the connector housing 4 by exchanging the aligning plate 3 which has been broken.

The connector 1 with the aligning plate having the above described structure is transported, in a state where the male terminals 5 are contained in the connector housing 4 and the aligning plate 3 is positioned at the temporarily locked position. In case where the worker's hand or the other connector different from the mating connector to be engaged is inserted into the engaging space 40, when this connector with the aligning plate is transported, for example, and the plate part 30 is forcibly pressed toward the terminal container 44, the arm portion 60 is pulled inward into the engaging space 40 to be flexed inward. In this manner, the plate part 30 is prevented from moving toward the terminal container 44, having the sufficient overlapping amount between the projection 63 and the plate part 30, and the aligning plate 3 is reliably held at the temporarily locked position.

The above described embodiment represents only a typical form of the invention, but the invention is not limited to the embodiment. In other words, the invention can be put into practical use, while making various modifications within a scope not deviating from the spirit of the invention.

What is claimed is:

1. A connector, comprising:

a connector housing having an inner wall;

an engaging space which is provided in the connector housing, and has an entrance to receive a mating connector through the entrance;

a terminal container which is provided in the connector housing to be opposed to the entrance of the engaging space;

a male terminal including a base end fitted to the terminal container and an electric connecting portion extended from the base end into the engaging space;

an aligning plate which is arranged within the engaging space, is provided with a terminal insertion hole for passing the electric connecting portion therethrough, and is adapted to move in the engaging space between a temporarily locked position and a permanently locked position, the temporarily locked position representing a position in which the terminal insertion hole is positioned at one end part of the electric connecting portion remote from the base end prior to engagement of the mating connector, and the permanently locked position representing a position in which the terminal insertion hole is positioned at the other end part of the electric connecting portion close to the base end after the engagement of the mating connector;

a temporarily locking hook including: an arm portion which is extended from the inner wall toward the terminal container and positioned outside of the aligning plate; and a projection which is projected from an end of the arm portion remote from the inner wall and adapted to be butted against a surface of the aligning plate at a side facing the terminal container so as to hold the aligning plate at the temporarily locked position; and a contact part provided on the projection to contact the aligning plate, so that a vector for pulling the arm portion inward into the engaging space is generated when the aligning plate is pressed toward the terminal container.

2. The connector as claimed in claim 1, wherein the aligning plate includes a dent in a concave shape, and the contact part is brought into contact with an inner face of the dent.

3. The connector as claimed in claim 1, wherein the contact part is brought into line contact with the aligning plate.

4. The connector as claimed in claim 1, wherein the arm portion is curved in a direction toward a center of the engaging space as the arm portion goes toward the terminal container, in a state where a pressure is not applied to the arm portion.

5. The connector as claimed in claim 1, wherein the aligning plate includes a shearing part which has a smaller thickness than other parts of the aligning plate, and is adapted to be sheared when the aligning plate is pressed toward the terminal container with a force exceeding a limit value of stress thereof.

* * * * *